US009203167B2

(12) United States Patent
Holliday et al.

(10) Patent No.: US 9,203,167 B2
(45) Date of Patent: Dec. 1, 2015

(54) COAXIAL CABLE CONNECTOR WITH CONDUCTIVE SEAL

(75) Inventors: Randall A. Holliday, Broomfield, CO (US); Robert M. Parker, Aurora, CO (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 13/479,123

(22) Filed: May 23, 2012

(65) Prior Publication Data

US 2013/0023151 A1 Jan. 24, 2013

Related U.S. Application Data

(60) Provisional application No. 61/490,373, filed on May 26, 2011.

(51) Int. Cl.

| | |
|---|---|
| ***H01R 9/05*** | (2006.01) |
| ***H01R 24/38*** | (2011.01) |
| *H01R 103/00* | (2006.01) |

(52) U.S. Cl.

CPC ..... *H01R 9/05* (2013.01); *H01R 24/38* (2013.01); *H01R 2103/00* (2013.01)

(58) Field of Classification Search

USPC ..... 439/578, 584, 585

See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,013,526 | A | 9/1935 | Schmitt |
| 2,102,495 | A | 12/1937 | England |
| 2,258,737 | A | 10/1941 | Browne |
| 2,325,549 | A | 7/1943 | Ryzowitz |

(Continued)

FOREIGN PATENT DOCUMENTS

| | | | |
|---|---|---|---|
| CA | 2096710 | A1 | 11/1994 |
| CN | 101060690 | A | 10/2007 |

(Continued)

OTHER PUBLICATIONS

ARRIS1; Digicon AVL Connector. ARRIS Group Inc. [online]. 3 pages. [retrieved on Apr. 22, 2010]. Retrieved from the Internet<URL: http://www.arrisi.com/special/digiconAVL.asp>.

(Continued)

*Primary Examiner* — Hien Vu

(74) *Attorney, Agent, or Firm* — Barclay Damon, LLP

(57) ABSTRACT

A coaxial cable connector for connection to a terminal includes inner and outer spaced concentric sleeves configured to cooperate in retaining an end of a coaxial cable, at least one of the inner and outer sleeves having a flange at its forward end and a coupling member configured to draw the flange toward an end of the terminal. The coupling member and the flange have confronting surface portions therebetween. The connector further includes an annular electrically conductive member disposed between the confronting surface portions for establishing conductivity between the coupling member and the flange when the coupling member and the flange are drawn into proximity with one another.

20 Claims, 3 Drawing Sheets

(56) References Cited

U.S. PATENT DOCUMENTS

| | | | | |
|---|---|---|---|---|
| 2,480,963 | A | | 9/1949 | Quinn |
| 2,544,654 | A | | 3/1951 | Brown |
| 2,549,647 | A | | 4/1951 | Turenne |
| 2,665,729 | A | | 1/1954 | Terry |
| 2,694,187 | A | | 11/1954 | Nash |
| 2,694,817 | A | | 11/1954 | Roderick |
| 2,754,487 | A | | 7/1956 | Carr et al. |
| 2,755,331 | A | | 7/1956 | Melcher |
| 2,757,351 | A | | 7/1956 | Klostermann |
| 2,762,025 | A | | 9/1956 | Melcher |
| 2,805,399 | A | | 9/1957 | Leeper |
| 2,816,949 | A | | 12/1957 | Curtiss |
| 2,870,420 | A | | 1/1959 | Malek |
| 3,001,169 | A | | 9/1961 | Blonder |
| 3,015,794 | A | | 1/1962 | Kishbaugh |
| 3,091,748 | A | | 5/1963 | Takes et al. |
| 3,094,364 | A | | 6/1963 | Lingg |
| 3,184,706 | A | | 5/1965 | Atkins |
| 3,194,292 | A | | 7/1965 | Borowsky |
| 3,196,382 | A | | 7/1965 | Morello, Jr. |
| 3,245,027 | A | | 4/1966 | Ziegler, Jr. |
| 3,275,913 | A | | 9/1966 | Blanchard et al. |
| 3,278,890 | A | | 10/1966 | Cooney |
| 3,281,757 | A | | 10/1966 | Bonhomme |
| 3,292,136 | A | | 12/1966 | Somerset |
| 3,320,575 | A | | 5/1967 | Brown et al. |
| 3,321,732 | A | | 5/1967 | Forney, Jr. |
| 3,336,563 | A | | 8/1967 | Hyslop |
| 3,348,186 | A | | 10/1967 | Rosen |
| 3,350,677 | A | | 10/1967 | Daum |
| 3,355,698 | A | | 11/1967 | Keller |
| 3,373,243 | A | | 3/1968 | Janowiak et al. |
| 3,390,374 | A | | 6/1968 | Forney, Jr. |
| 3,406,373 | A | | 10/1968 | Forney, Jr. |
| 3,430,184 | A | | 2/1969 | Acord |
| 3,448,430 | A | | 6/1969 | Kelly |
| 3,453,376 | A | | 7/1969 | Ziegler, Jr. et al. |
| 3,465,281 | A | | 9/1969 | Florer |
| 3,475,545 | A | | 10/1969 | Stark et al. |
| 3,494,400 | A | | 2/1970 | McCoy et al. |
| 3,498,647 | A | | 3/1970 | Schroder |
| 3,501,737 | A | | 3/1970 | Harris et al. |
| 3,517,373 | A | | 6/1970 | Jamon |
| 3,526,871 | A | | 9/1970 | Hobart |
| 3,533,051 | A | | 10/1970 | Ziegler, Jr. |
| 3,537,065 | A | | 10/1970 | Winston |
| 3,544,705 | A | | 12/1970 | Winston |
| 3,551,882 | A | | 12/1970 | O'Keefe |
| 3,564,487 | A | | 2/1971 | Upstone et al. |
| 3,587,033 | A | | 6/1971 | Brorein et al. |
| 3,601,776 | A | | 8/1971 | Curl |
| 3,629,792 | A | | 12/1971 | Dorrell |
| 3,633,150 | A | | 1/1972 | Swartz |
| 3,646,502 | A | | 2/1972 | Hutter et al. |
| 3,663,926 | A | | 5/1972 | Brandt |
| 3,665,371 | A | | 5/1972 | Cripps |
| 3,668,612 | A | | 6/1972 | Nepovim |
| 3,669,472 | A | | 6/1972 | Nadsady |
| 3,671,922 | A | | 6/1972 | Zerlin et al. |
| 3,678,444 | A | | 7/1972 | Stevens et al. |
| 3,678,445 | A | | 7/1972 | Brancaleone |
| 3,680,034 | A | | 7/1972 | Chow et al. |
| 3,681,739 | A | | 8/1972 | Kornick |
| 3,683,320 | A | | 8/1972 | Woods et al. |
| 3,686,623 | A | | 8/1972 | Nijman |
| 3,694,792 | A | | 9/1972 | Wallo |
| 3,706,958 | A | | 12/1972 | Blanchenot |
| 3,710,005 | A | | 1/1973 | French |
| 3,739,076 | A | | 6/1973 | Schwartz |
| 3,744,007 | A | | 7/1973 | Horak |
| 3,744,011 | A | | 7/1973 | Blanchenot |
| 3,778,535 | A | | 12/1973 | Forney, Jr. |
| 3,781,762 | A | | 12/1973 | Quackenbush |
| 3,781,898 | A | | 12/1973 | Holloway |
| 3,793,610 | A | | 2/1974 | Brishka |
| 3,798,589 | A | | 3/1974 | Deardurff |
| 3,808,580 | A | | 4/1974 | Johnson |
| 3,810,076 | A | | 5/1974 | Hutter |
| 3,835,443 | A | | 9/1974 | Arnold et al. |
| 3,836,700 | A | | 9/1974 | Niemeyer |
| 3,845,453 | A | | 10/1974 | Hemmer |
| 3,846,738 | A | | 11/1974 | Nepovim |
| 3,854,003 | A | | 12/1974 | Duret |
| 3,858,156 | A | | 12/1974 | Zarro |
| 3,870,978 | A | * | 3/1975 | Dreyer ..... 333/260 |
| 3,879,102 | A | | 4/1975 | Horak |
| 3,886,301 | A | | 5/1975 | Cronin et al. |
| 3,907,399 | A | | 9/1975 | Spinner |
| 3,910,673 | A | | 10/1975 | Stokes |
| 3,915,539 | A | | 10/1975 | Collins |
| 3,936,132 | A | | 2/1976 | Hutter |
| 3,953,097 | A | | 4/1976 | Graham |
| 3,960,428 | A | | 6/1976 | Naus et al. |
| 3,963,320 | A | | 6/1976 | Spinner |
| 3,963,321 | A | | 6/1976 | Burger et al. |
| 3,970,355 | A | | 7/1976 | Pitschi |
| 3,972,013 | A | | 7/1976 | Shapiro |
| 3,976,352 | A | | 8/1976 | Spinner |
| 3,980,805 | A | | 9/1976 | Lipari |
| 3,985,418 | A | | 10/1976 | Spinner |
| 4,017,139 | A | | 4/1977 | Nelson |
| 4,022,966 | A | | 5/1977 | Gajajiva |
| 4,030,798 | A | | 6/1977 | Paoli |
| 4,046,451 | A | | 9/1977 | Juds et al. |
| 4,053,200 | A | | 10/1977 | Pugner |
| 4,059,330 | A | | 11/1977 | Shirey |
| 4,079,343 | A | | 3/1978 | Nijman |
| 4,082,404 | A | | 4/1978 | Flatt |
| 4,090,028 | A | | 5/1978 | Vontobel |
| 4,093,335 | A | | 6/1978 | Schwartz et al. |
| 4,106,839 | A | | 8/1978 | Cooper |
| 4,109,126 | A | | 8/1978 | Halbeck |
| 4,125,308 | A | | 11/1978 | Schilling |
| 4,126,372 | A | | 11/1978 | Hashimoto et al. |
| 4,131,332 | A | | 12/1978 | Hogendobler et al. |
| 4,150,250 | A | | 4/1979 | Lundeberg |
| 4,153,320 | A | | 5/1979 | Townshend |
| 4,156,554 | A | | 5/1979 | Aujla |
| 4,165,911 | A | | 8/1979 | Laudig |
| 4,168,921 | A | | 9/1979 | Blanchard |
| 4,173,385 | A | | 11/1979 | Fenn et al. |
| 4,174,875 | A | | 11/1979 | Wilson et al. |
| 4,187,481 | A | | 2/1980 | Boutros |
| 4,193,655 | A | | 3/1980 | Herrmann, Jr. |
| 4,194,338 | A | | 3/1980 | Trafton |
| 4,213,664 | A | * | 7/1980 | McClenan ..... 439/95 |
| 4,225,162 | A | | 9/1980 | Dola |
| 4,227,765 | A | | 10/1980 | Neumann et al. |
| 4,229,714 | A | | 10/1980 | Yu |
| 4,250,348 | A | | 2/1981 | Kitagawa |
| 4,280,749 | A | | 7/1981 | Hemmer |
| 4,285,564 | A | | 8/1981 | Spinner |
| 4,290,663 | A | | 9/1981 | Fowler et al. |
| 4,296,986 | A | | 10/1981 | Herrmann, Jr. |
| 4,307,926 | A | | 12/1981 | Smith |
| 4,322,121 | A | | 3/1982 | Riches et al. |
| 4,326,769 | A | | 4/1982 | Dorsey et al. |
| 4,339,166 | A | | 7/1982 | Dayton |
| 4,346,958 | A | | 8/1982 | Blanchard |
| 4,354,721 | A | | 10/1982 | Luzzi |
| 4,358,174 | A | | 11/1982 | Dreyer |
| 4,359,254 | A | | 11/1982 | Gallusser |
| 4,373,767 | A | | 2/1983 | Cairns |
| 4,389,081 | A | | 6/1983 | Gallusser et al. |
| 4,400,050 | A | | 8/1983 | Hayward |
| 4,407,529 | A | | 10/1983 | Holman |
| 4,408,821 | A | | 10/1983 | Forney, Jr. |
| 4,408,822 | A | | 10/1983 | Nikitas |
| 4,412,717 | A | | 11/1983 | Monroe |
| 4,421,377 | A | | 12/1983 | Spinner |
| 4,426,127 | A | | 1/1984 | Kubota |
| 4,444,453 | A | | 4/1984 | Kirby et al. |
| 4,452,503 | A | | 6/1984 | Forney, Jr. |
| 4,456,323 | A | | 6/1984 | Pitcher et al. |

(56) References Cited

U.S. PATENT DOCUMENTS

| | | | |
|---|---|---|---|
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,720,155 | A | 1/1988 | Schildkraut et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,126 | A | 4/1988 | Gutter et al. |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,813,886 | A | 3/1989 | Roos et al. |
| 4,820,185 | A | 4/1989 | Moulin |
| 4,834,675 | A | 5/1989 | Samchisen |
| 4,835,342 | A | 5/1989 | Guginsky |
| 4,836,801 | A | 6/1989 | Ramirez |
| 4,838,813 | A | 6/1989 | Pauza et al. |
| 4,854,893 | A | 8/1989 | Morris |
| 4,857,014 | A | 8/1989 | Alf et al. |
| 4,867,706 | A | 9/1989 | Tang |
| 4,869,679 | A | 9/1989 | Szegda |
| 4,874,331 | A | 10/1989 | Iverson |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |
| 4,927,385 | A | 5/1990 | Cheng |
| 4,929,188 | A | 5/1990 | Lionetto et al. |
| 4,934,960 | A | 6/1990 | Capp et al. |
| 4,938,718 | A | 7/1990 | Guendel |
| 4,941,846 | A | 7/1990 | Guimond et al. |
| 4,952,174 | A | 8/1990 | Sucht et al. |
| 4,957,456 | A | 9/1990 | Olson et al. |
| 4,973,265 | A | 11/1990 | Heeren |
| 4,979,911 | A | 12/1990 | Spencer |
| 4,990,104 | A | 2/1991 | Schieferly |
| 4,990,105 | A | 2/1991 | Karlovich |
| 4,990,106 | A | 2/1991 | Szegda |
| 4,992,061 | A | 2/1991 | Brush, Jr. et al. |
| 5,002,503 | A | 3/1991 | Campbell et al. |
| 5,007,861 | A | 4/1991 | Stirling |
| 5,011,422 | A | 4/1991 | Yeh |
| 5,011,432 | A | 4/1991 | Sucht et al. |
| 5,021,010 | A | 6/1991 | Wright |
| 5,024,606 | A | 6/1991 | Ming-Hwa |
| 5,030,126 | A | 7/1991 | Hanlon |
| 5,037,328 | A | 8/1991 | Karlovich |
| 5,046,964 | A | 9/1991 | Welsh et al. |
| 5,052,947 | A | 10/1991 | Brodie et al. |
| 5,055,060 | A | 10/1991 | Down et al. |
| 5,059,747 | A | 10/1991 | Bawa et al. |
| 5,062,804 | A | 11/1991 | Jamet et al. |
| 5,066,248 | A | 11/1991 | Gaver, Jr. et al. |
| 5,073,129 | A | 12/1991 | Szegda |
| 5,080,600 | A | 1/1992 | Baker et al. |
| 5,083,943 | A | 1/1992 | Tarrant |
| 5,120,260 | A | 6/1992 | Jackson |
| 5,127,853 | A | 7/1992 | McMills et al. |
| 5,131,862 | A | 7/1992 | Gershfeld |
| 5,137,470 | A | 8/1992 | Doles |
| 5,137,471 | A | 8/1992 | Verespej et al. |
| 5,141,448 | A | 8/1992 | Mattingly et al. |
| 5,141,451 | A | 8/1992 | Down |
| 5,149,274 | A | 9/1992 | Gallusser et al. |
| 5,154,636 | A | 10/1992 | Vaccaro et al. |
| 5,161,993 | A | 11/1992 | Leibfried, Jr. |
| 5,166,477 | A | 11/1992 | Perin, Jr. et al. |
| 5,169,323 | A | 12/1992 | Kawai et al. |
| 5,181,161 | A | 1/1993 | Hirose et al. |
| 5,183,417 | A | 2/1993 | Bools |
| 5,186,501 | A | 2/1993 | Mano |
| 5,186,655 | A | 2/1993 | Glenday et al. |
| 5,195,905 | A | 3/1993 | Pesci |
| 5,195,906 | A | 3/1993 | Szegda |
| 5,205,547 | A | 4/1993 | Mattingly |
| 5,205,761 | A | 4/1993 | Nilsson |
| 5,207,602 | A | 5/1993 | McMills et al. |
| 5,215,477 | A | 6/1993 | Weber et al. |
| 5,217,391 | A | 6/1993 | Fisher, Jr. |
| 5,217,393 | A | 6/1993 | Del Negro et al. |
| 5,221,216 | A | 6/1993 | Gabany et al. |
| 5,227,587 | A | 7/1993 | Paterek |
| 5,247,424 | A | 9/1993 | Harris et al. |
| 5,269,701 | A | 12/1993 | Leibfried, Jr. |
| 5,283,853 | A | 2/1994 | Szegda |
| 5,284,449 | A | 2/1994 | Vaccaro |

(56) References Cited

U.S. PATENT DOCUMENTS 5,294,864 A 3/1994 Do
5,295,864 A 3/1994 Birch et al.
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,509,823 A * 4/1996 Harting et al. ..... 439/607.17
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,897,795 A 4/1999 Lu et al.
5,921,793 A 7/1999 Phillips
5,938,465 A 8/1999 Fox, Sr.
5,944,548 A 8/1999 Saito
5,951,327 A 9/1999 Marik
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,162,995 A 12/2000 Bachle et al.
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,257,923 B1 7/2001 Stone et al.
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,705,884 B1 3/2004 McCarthy
6,709,280 B1 3/2004 Gretz
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,752,633 B2 6/2004 Aizawa et al.
6,767,248 B1 7/2004 Hung
6,769,926 B1 8/2004 Montena
6,769,933 B2 8/2004 Bence et al.
6,780,029 B1 8/2004 Gretz
6,780,052 B2 8/2004 Montena et al.

(56) References Cited

U.S. PATENT DOCUMENTS 6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,817,897 B2 11/2004 Chee
6,848,939 B2 2/2005 Stirling
6,848,940 B2 2/2005 Montena
6,873,864 B2 3/2005 Kai et al.
6,882,247 B2 4/2005 Allison et al.
6,884,113 B1 4/2005 Montena
6,884,115 B2 4/2005 Malloy
6,898,940 B2 5/2005 Gram et al.
6,916,200 B2 7/2005 Burris et al.
6,926,508 B2 8/2005 Brady et al.
6,929,265 B2 8/2005 Holland et al.
6,929,508 B1 8/2005 Holland
6,939,169 B2 9/2005 Islam et al.
6,948,976 B2 9/2005 Goodwin et al.
6,971,912 B2 12/2005 Montena et al.
7,004,788 B2 2/2006 Montena
7,011,547 B1 3/2006 Wu
7,029,304 B2 4/2006 Montena
7,029,326 B2 4/2006 Montena
7,063,565 B2 6/2006 Ward
7,070,447 B1 7/2006 Montena
7,074,081 B2 7/2006 Hsia
7,086,897 B2 8/2006 Montena
7,097,499 B1 8/2006 Purdy
7,097,500 B2 8/2006 Montena
7,102,868 B2 9/2006 Montena
7,108,548 B2 9/2006 Burris et al.
7,114,990 B2 10/2006 Bence et al.
7,118,416 B2 10/2006 Montena et al.
7,125,283 B1 10/2006 Lin
7,128,603 B2 10/2006 Burris et al.
7,128,605 B2 10/2006 Montena
7,131,867 B1 11/2006 Foster et al.
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 2/2007 Burris et al.
7,186,127 B2 3/2007 Montena
7,189,113 B2 3/2007 Sattele et al.
7,198,507 B2 4/2007 Tusini
7,207,820 B1 4/2007 Montena
7,229,303 B2 6/2007 Vermoesen et al.
7,241,172 B2 7/2007 Rodrigues et al.
7,252,546 B1 8/2007 Holland
7,255,598 B2 8/2007 Montena et al.
7,264,503 B2 9/2007 Montena
7,299,520 B2 11/2007 Huang
7,299,550 B2 11/2007 Montena
7,300,309 B2 11/2007 Montena
7,309,255 B2 12/2007 Rodrigues
7,354,309 B2 4/2008 Palinkas
7,371,112 B2 5/2008 Burris et al.
7,371,113 B2 5/2008 Burris et al.
7,375,533 B2 5/2008 Gale
7,393,245 B2 7/2008 Palinkas et al.
7,404,737 B1 7/2008 Youtsey
7,442,081 B2 10/2008 Burke et al.
7,452,237 B1 11/2008 Montena
7,452,239 B2 11/2008 Montena
7,455,549 B2 11/2008 Rodrigues et al.
7,455,550 B1 11/2008 Sykes
7,462,068 B2 12/2008 Amidon
7,476,127 B1 1/2009 Wei
7,479,033 B1 1/2009 Sykes et al.
7,479,035 B2 1/2009 Bence et al.
7,480,991 B2 1/2009 Khemakhem et al.
7,488,210 B1 2/2009 Burris et al.
7,494,355 B2 2/2009 Hughes et al.
7,497,729 B1 3/2009 Wei
7,507,117 B2 3/2009 Amidon
7,513,795 B1 4/2009 Shaw
7,544,094 B1 6/2009 Paglia et al.
7,566,236 B2 7/2009 Malloy et al.
7,568,945 B2 8/2009 Chee et al.
7,607,942 B1 10/2009 Van Swearingen
7,644,755 B2 1/2010 Stoesz et al.
7,674,132 B1 3/2010 Chen
7,682,177 B2 3/2010 Berthet
7,727,011 B2 6/2010 Montena et al.
7,753,705 B2 7/2010 Montena
7,753,727 B1 7/2010 Islam et al.
7,792,148 B2 9/2010 Carlson et al.
7,794,275 B2 9/2010 Rodrigues
7,798,849 B2 9/2010 Montena
7,806,714 B2 10/2010 Williams et al.
7,806,725 B1 10/2010 Chen
7,811,133 B2 10/2010 Gray
7,824,216 B2 11/2010 Purdy
7,828,595 B2 11/2010 Mathews
7,828,596 B2 11/2010 Malak
7,830,154 B2 11/2010 Gale
7,833,053 B2 11/2010 Mathews
7,837,501 B2 11/2010 Youtsey
7,845,963 B2 12/2010 Gastineau
7,845,976 B2 12/2010 Mathews
7,845,978 B1 12/2010 Chen
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,927,135 B1 4/2011 Wlos
7,934,954 B1 5/2011 Chawgo et al.
7,950,958 B2 5/2011 Mathews
7,955,126 B2 6/2011 Bence et al.
7,972,158 B2 7/2011 Wild et al.
8,029,315 B2 10/2011 Purdy et al.
8,033,862 B2 10/2011 Radzik et al.
8,062,044 B2 11/2011 Montena et al.
8,062,063 B2 11/2011 Malloy et al.
8,075,337 B2 12/2011 Malloy et al.
8,075,338 B1 12/2011 Montena
8,075,339 B2 * 12/2011 Holliday ..... 439/584
8,079,860 B1 12/2011 Zraik
8,113,875 B2 2/2012 Malloy et al.
8,152,551 B2 4/2012 Zraik
8,157,588 B1 4/2012 Rodrigues et al.
8,157,589 B2 4/2012 Krenceski et al.
8,167,635 B1 5/2012 Mathews
8,167,636 B1 5/2012 Montena
8,167,646 B1 5/2012 Mathews
8,172,612 B2 5/2012 Bence et al.
8,186,919 B2 5/2012 Blair
8,192,237 B2 6/2012 Purdy et al.
8,206,176 B2 * 6/2012 Islam ..... 439/578
8,231,406 B2 7/2012 Burris et al.
8,231,412 B2 7/2012 Paglia et al.
8,287,320 B2 10/2012 Purdy et al.
8,313,345 B2 11/2012 Purdy
8,313,353 B2 11/2012 Purdy et al.
8,323,053 B2 12/2012 Montena
8,323,060 B2 12/2012 Purdy et al.
8,328,577 B1 12/2012 Lu
8,337,229 B2 12/2012 Montena
8,348,697 B2 1/2013 Zraik
8,366,481 B2 2/2013 Ehret et al.
8,376,769 B2 2/2013 Holland et al.
8,382,517 B2 2/2013 Mathews
8,398,421 B2 3/2013 Haberek et al.
8,414,322 B2 4/2013 Montena
8,444,445 B2 5/2013 Amidon et al.
8,469,740 B2 6/2013 Ehret et al.
8,475,205 B2 7/2013 Ehret et al.
8,480,430 B2 7/2013 Ehret et al.
8,480,431 B2 7/2013 Ehret et al.

(56) References Cited

U.S. PATENT DOCUMENTS

| | | | | |
|---|---|---|---|---|
| 8,485,845 | B2 | 7/2013 | Ehret et al. | |
| 8,506,325 | B2 | 8/2013 | Malloy et al. | |
| 8,517,763 | B2 | 8/2013 | Burris et al. | |
| 8,529,279 | B2 | 9/2013 | Montena | |
| 8,550,835 | B2 * | 10/2013 | Montena | 439/322 |
| 8,562,366 | B2 | 10/2013 | Purdy et al. | |
| 8,597,041 | B2 * | 12/2013 | Purdy et al. | 439/322 |
| 2002/0013088 | A1 | 1/2002 | Rodrigues et al. | |
| 2002/0038720 | A1 | 4/2002 | Kai et al. | |
| 2003/0068924 | A1 | 4/2003 | Montena | |
| 2003/0214370 | A1 | 11/2003 | Allison et al. | |
| 2003/0224657 | A1 | 12/2003 | Malloy | |
| 2004/0013096 | A1 | 1/2004 | Marinier et al. | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2005/0233636 | A1 | 10/2005 | Rodrigues et al. | |
| 2006/0099853 | A1 | 5/2006 | Sattele et al. | |
| 2006/0110977 | A1 | 5/2006 | Matthews | |
| 2006/0154519 | A1 | 7/2006 | Montena | |
| 2006/0166552 | A1 | 7/2006 | Bence et al. | |
| 2006/0205272 | A1 | 9/2006 | Rodrigues | |
| 2006/0276079 | A1 | 12/2006 | Chen | |
| 2007/0026734 | A1 | 2/2007 | Bence et al. | |
| 2007/0049113 | A1 | 3/2007 | Rodrigues et al. | |
| 2007/0123101 | A1 | 5/2007 | Palinkas | |
| 2007/0155232 | A1 | 7/2007 | Burris et al. | |
| 2007/0175027 | A1 | 8/2007 | Khemakhem et al. | |
| 2007/0243759 | A1 | 10/2007 | Rodrigues et al. | |
| 2007/0243762 | A1 | 10/2007 | Burke et al. | |
| 2008/0102696 | A1 | 5/2008 | Montena | |
| 2008/0192674 | A1 | 8/2008 | Wang et al. | |
| 2008/0225783 | A1 | 9/2008 | Wang et al. | |
| 2008/0248689 | A1 | 10/2008 | Montena | |
| 2008/0289470 | A1 | 11/2008 | Aston | |
| 2009/0017803 | A1 | 1/2009 | Brilhart et al. | |
| 2009/0029590 | A1 | 1/2009 | Sykes et al. | |
| 2009/0098770 | A1 | 4/2009 | Bence et al. | |
| 2009/0176396 | A1 | 7/2009 | Mathews | |
| 2010/0055978 | A1 | 3/2010 | Montena | |
| 2010/0081321 | A1 | 4/2010 | Malloy et al. | |
| 2010/0081322 | A1 | 4/2010 | Malloy et al. | |
| 2010/0105246 | A1 | 4/2010 | Burris et al. | |
| 2010/0233901 | A1 | 9/2010 | Wild et al. | |
| 2010/0233902 | A1 | 9/2010 | Youtsey | |
| 2010/0255720 | A1 | 10/2010 | Radzik et al. | |
| 2010/0255721 | A1 | 10/2010 | Purdy | |
| 2010/0279548 | A1 | 11/2010 | Montena et al. | |
| 2010/0297871 | A1 | 11/2010 | Haube | |
| 2010/0297875 | A1 | 11/2010 | Purdy et al. | |
| 2011/0021072 | A1 | 1/2011 | Purdy | |
| 2011/0027039 | A1 | 2/2011 | Blair | |
| 2011/0053413 | A1 | 3/2011 | Mathews | |
| 2011/0086543 | A1 | 4/2011 | Alrutz | |
| 2011/0111623 | A1 | 5/2011 | Burris et al. | |
| 2011/0117774 | A1 | 5/2011 | Malloy et al. | |
| 2011/0143567 | A1 | 6/2011 | Purdy et al. | |
| 2011/0230089 | A1 | 9/2011 | Amidon et al. | |
| 2011/0230091 | A1 | 9/2011 | Krenceski et al. | |
| 2011/0250789 | A1 | 10/2011 | Burris et al. | |
| 2012/0021642 | A1 | 1/2012 | Zraik | |
| 2012/0040537 | A1 | 2/2012 | Burris | |
| 2012/0045933 | A1 | 2/2012 | Youtsey | |
| 2012/0094530 | A1 | 4/2012 | Montena | |
| 2012/0094532 | A1 | 4/2012 | Montena | |
| 2012/0122329 | A1 | 5/2012 | Montena | |
| 2012/0129387 | A1 | 5/2012 | Holland et al. | |
| 2012/0145454 | A1 | 6/2012 | Montena | |
| 2012/0171894 | A1 * | 7/2012 | Malloy et al. | 439/578 |
| 2012/0196476 | A1 | 8/2012 | Haberek et al. | |
| 2012/0202378 | A1 | 8/2012 | Krenceski et al. | |
| 2012/0214342 | A1 | 8/2012 | Mathews | |
| 2012/0222302 | A1 | 9/2012 | Purdy et al. | |
| 2012/0225581 | A1 | 9/2012 | Amidon et al. | |
| 2012/0252263 | A1 | 10/2012 | Ehret et al. | |
| 2012/0270441 | A1 | 10/2012 | Bence et al. | |
| 2013/0034983 | A1 | 2/2013 | Purdy et al. | |
| 2013/0065433 | A1 | 3/2013 | Burris | |
| 2013/0065435 | A1 | 3/2013 | Purdy et al. | |
| 2013/0072059 | A1 | 3/2013 | Purdy et al. | |
| 2013/0102188 | A1 | 4/2013 | Montena | |
| 2013/0102189 | A1 | 4/2013 | Montena | |
| 2013/0102190 | A1 | 4/2013 | Chastain et al. | |
| 2013/0164975 | A1 | 6/2013 | Blake et al. | |
| 2013/0171869 | A1 | 7/2013 | Chastain et al. | |
| 2013/0171870 | A1 | 7/2013 | Chastain et al. | |
| 2013/0183857 | A1 | 7/2013 | Ehret et al. | |
| 2013/0337683 | A1 | 12/2013 | Chastain et al. | |
| 2014/0051285 | A1 | 2/2014 | Raley et al. | |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| CN | 201904508 | | 7/2011 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | A1 | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A1 | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| GB | 2477479 | | 8/2010 |
| JP | 3074864 | | 1/2001 |
| JP | 2002-015823 | | 1/2002 |
| JP | 4503793 | B9 | 1/2002 |
| JP | 2002075556 | A | 3/2002 |
| JP | 2001102299 | | 4/2002 |
| JP | 3280369 | B2 | 5/2002 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 2069457 | A1 | 9/2002 |
| WO | 2004013883 | A2 | 2/2004 |
| WO | 2006081141 | A1 | 8/2006 |
| WO | 20100135181 | | 11/2010 |

(56) References Cited

FOREIGN PATENT DOCUMENTS

| | | | |
|---|---|---|---|
| WO | 2011128665 | A1 | 10/2011 |
| WO | 2011128666 | A1 | 10/2011 |
| WO | 2012061379 | A2 | 5/2012 |

OTHER PUBLICATIONS

ISR1; PCT/US2011/057939 Date of Mailing: Apr. 30, 2012 International Search Report and Written Opinion. pp. 8.
LIT10; Defendant's Disclosure of Preliminary Invalidity Contentions, Served Oct. 31, 2013, *PPC Broadband, Inc. d/b/a PPC* v. *Times Fiber Communications, Inc.*, United States District Court Northern district of New York, Civil Action No. 5:13-CV-0460-TJM-DEP, 48 pages.
LIT12a; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert, Inc.*, United States District Court Northern District of New York, Civil Action No. 5:12-CV-00911-GLS-DEP, pp. 1-90.
LIT12b; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert, Inc.*, United States District Court Northern District of New York, Civil Action No. 5:12-CV-00911-GLS-DEP, pp. 91-199.
LIT12c; Defendant Corning Gilbert, Inc.'s Supplemental Disclosure of Non-Infringement, Invalidity, and Unenforceability Contentions (including Appendices A-D), Served Feb. 11, 2013, *John Mezzalingua Associates, Inc., d/b/a PPC*, v. *Corning Gilbert, Inc.*, United States District Court Northern District of New York, Civil Action No. 5:12-CV-00911-GLS-DEP, pp. 200-383.
LIT16; Report and Recommendation, Issued Dec. 5, 2013, *John Mezzalingua Associates, Inc., d/b/a PPC*, v. *Corning Gilbert, Inc.*, United States District Court Northern District of New York, Civil Action No. 5:12-CV-00911-GLS-DEP, 52 pages.
NOA1; Notice of Allowance (Mail Date: Feb. 24, 2012) for U.S. Appl. No. 13/033,127, filed Feb. 23, 2011.
NOA2; Notice of Allowance (Mail Date: Jan. 24, 2013) for U.S. Appl. No. 13/072,350.
NOA3; Notice of Alowance (Date mailed: Jun. 25, 2012) for U.S. Appl. No. 12/633,792, filed Dec. 8, 2009.
NOA4; Notice of Allowance (Mail Date Mar. 20, 2012) for U.S. Appl. No. 13/117,843, filed May 27, 2011.
OA1; Office Action mail date Mar. 29, 2013 for U.S. Appl. No. 13/712,470.
OA10; Final Office Action (Mail Date: Oct. 25, 2011) for U.S. Appl. No. 13/033,127, filed Feb. 23, 2011.
OA11; Office Action (Mail Date: Oct. 24, 2011) for U.S. Appl. No. 12/633,792, filed Dec. 8, 2009.
OA2; Office Action (Mail Date Mar. 6, 2013) for U.S. Appl. No. 13/726,330, filed Dec. 24, 2012.
OA3; Office Action (Mail Date Feb. 20, 2013) for U.S. Appl. No. 13/726,349, filed Dec. 24, 2012.
OA4; Office Action (Mail Date Feb. 20, 2013) for U.S. Appl. No. 13/726,339, filed Dec. 24, 2012.
OA5; Office Action (Mail Date Mar. 11, 2013) for U.S. Appl. No. 13/726,347, filed Dec. 24, 2012.
OA6; Office Action (Mail Date Feb. 20, 2013) for U.S. Appl. No. 13/726,356, filed Dec. 24, 2012.
OA7; Office Action (mail date Apr. 12, 2013) for U.S. Appl. No. 13/712,498, filed Dec. 12, 2012.
OA8; Office Action (mail date Jun. 11, 2013) for U.S. Appl. No. 13/860,964, filed Apr. 11, 2013.
OA9; Office Action (Mail Date: Jun. 2, 2011) for U.S. Appl. No. 13/033,127, filed Feb. 23, 2011.
Reexam1; U.S. Reexamination Control No. 90/012,300 of U.S. Pat. No. 8,172,612, filed Jun. 29, 2012.
RES1; Response dated Jun. 24, 2011 to Office Action (Mail Date: Jun. 2, 2011) for U.S. Appl. No. 13/033,127, filed Feb. 23, 2011.
TechDoc1; Philips, NXP, "PDCCH message information content for persistent scheduling," R1-081506, Agenda Item: 6.1.3, 3GPP TSG RAN WG1 Meeting #52bis, Shenzhen, China, Mar. 31-Apr. 4, 2008, 3 pages.
TechDoc10; PPC Product Guide, 2008.
TechDoc2; NTT DoCoMo, Inc. "UL semi-persistent resource deactivation," R2-082483 (resubmission of R2-081859), Agenda Item: 5.1.1.8, 3GPP TSG RAN WG2 #62, Kansas City, MO, USA, May 5-9, 2008, 2 pages.
TechDoc3; Panasonic, "Configuration for semi-persistent scheduling," R2-081575, Agenda Item: 5.1.1.8, 3GPP TSG RAN WG2 #61bis, Shenzhen, China, Mar. 31-Apr. 4, 2008, 4 pages.
TechDoc4; Panasonic, "Remaining issues on Persistent scheduling," R2-083311, derived from R2-082228 and R2-082229, Agenda Item: 6.1.1.8, 3GPP TSG RAN WG2 #62bis, Warsaw, Poland, Jun. 30-Jul. 4, 2008, 4 pages.
TechDoc5; Qualcomm Europe, "Release of semi-persistent resources," R2-082500 (was R2-081828), Agenda Item: 5.1.1.8 3GPP TSG-RAN WG2 meeting #62, Kansas City, MO, USA, May 5-9, 2008, 2 pages.
TechDoc6; Samsung, "C-RNTI and NDI for SPS," R2-084464, Agenda Item: 6.1.1.3, 3GPP TSG-RAN2#63 meeting, Jeju, South Korea, Aug. 18-22, 2008, 3 pages.
TechDoc7; Nokia Corporation, Nokia Siemens Networks, "Persistent Scheduling for DL," R2-080683 (RS-080018), 3GPP TSG-RAN WG2 Meeting #61, Agenda Item: 5.1.1.8, Sorrento, Italy, Feb. 11-15, 2008, 6 pages.
TechDoc8; Panasonic, "SPS activation and release," R1-084233, 3GPP TSG-RAN WG1 Meeting #55, Prague, Czech Republic, Nov. 10-14, 2008, 6 pages.
TechDoc9; PCT International, Inc., Compression Connectors Installation Guide, Aug. 3, 2009.
TechDoc11; NTT DoCoMo, Alcatel, Cingular Wireless, CMCC, Ericsson, Fujitsu, Huawei, LG Electronics, Lucent Technologies, Mitsubishi Electric, Motorola, NEC, Nokia, Nortel Networks, Orange, Panasonic, Philips, Qualcomm Europe, Samsung, Sharp Siemens, Telecom Italia, Telefonica, TeliaSonera, T-Mobile, Vodafone, "Proposed Study Item on Evolved UTRA and UTRAN," RP-040461, Agenda Item: 8.12, TSG-RAN Meeting #26, Athens, Greece, Dec. 8-10, 2004, 5 pages.
TechSpec1A; "3rd Generation Partnership Project; Technical Specification Group Radio Access Network; Requirements for Evolved UTRA (E-UTRA) and Evolved UTRAN (E-UTRAN) (Release 7)," Technical Report, 3GPP TR 125.913 V7.3.0, Mar. 2006, 18 pages.
TechSpec2A; "3rd Generation Partnership Project; Technical Specification Group Radio Access Network; Evolved Universal Terrestrial Radio Access (E-UTRA) and Evolved Universal Terrestrial Radio Access Network (E-UTRAN); Overall description; Stage 2 (Release 8)," Technical Specification, 3GPP TS 36.300 V8.5.0, May 2008, 134 pages.
TechSpec3A; "3rd Generation Partnership Project; Technical Specification Group Radio Access Network; Evolved Universal Terrestrial Radio Access (E-UTRA) Medium Access Control (MAC) protocol specification (Release 8)," Technical Specification, 3GPP TS 36.321 V8.2.0, May 2008, 32 pages.
TechSpec4A; "3rd Generation Partnership Project; Technical Specification Group Radio Access Netowrk; Evolved Universal Terrestrial Radio Access (E-UTRA); Physical layer procedures (Release 8)," Technical Specification, 3GPP TS 36.213 V8.4.0, Sep. 2008, 60 pages.
TechSpec5A; Society of Cable Telecommunications Engineers, Engineering Committee, Interface Practices Subcommittee; American National Standard; ANSI/SCTE 01 2006; "Specification for "F" Port, Female, Outdoor". Published Jan. 2006. 9 pages.
TechSpec6A; Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
Inter Partes Reexamination of U.S. Pat. No. 8,192,237 (Control No. 95/002,400).
Inter Partes Review Case IPR2013-00340—U.S. Pat. No. 8,323,060 (Claims 1-9).

(56) References Cited

OTHER PUBLICATIONS

Inter Partes Review Case IPR2013-00342—U.S. Pat. No. 8,323,060 (Claims 10-25).
Inter Partes Review Case IPR2013-00343—U.S. Pat. No. 8,313,353 (Claims 1-6).
Inter Partes Review Case IPR2013-00345—U.S. Pat. No. 8,313,353 (Claims 7-27).
Inter Partes Review Case IPR2013-00346—U.S. Pat. No. 8,287,320 (Claims 1-8, 10-16, and 18-31).
Inter Partes Review Case IPR2013-00347—U.S. Pat. No. 8,287,320 (Claims 9, 17, and 32).
Patent Application No. GB1109575.9 Examination Report Under Section 18(3); Date of Report: Jun. 23, 2011. 3 pp.
Patent No. ZL2010202597847; Evaluation Report of Utility Model Patent; Date of Report: Sep. 2, 2011. 8 pages. (Chinese version with English Translation (10 pages) provided).
PCT/US2010/034870; International Filing Date May 14, 2010. International Search Report and Written Opinion. Date of Mailing: Nov. 30, 2010. 7 pages.
Request for Inter Partes Reexamination (filed Sep. 13, 2012) of Purdy et al. U.S. Pat. No. 8,192,237 issued Jun. 5, 2012. 150 pages.
U.S. Reexamination Control No. 90/012,749 of U.S. Pat. No. 7,114,990, filed Dec. 21, 2012.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Disclosure of Preliminary Non-Infringement, Invalidity, and Unenforceability Contentions Filed Jul. 29, 2013. 86 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013. 14 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits B1-B6. 68 pages.
*PPC Broadband, Inc., d/b/a PPC*, v. *PCT International, Inc.*, USDC, Northern District of New York, Case No. 5:13-cv-0135-GTS-DEP, Defendant PCT International, Inc.'s Supplemental Disclosure of Preliminary Non-Infringement, Invalidity, and Unenforceability Contentions Filed Nov. 26, 2013, Exhibits C1-04. 122 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,366,481. 96 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,469,740. 78 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,475,205. 236 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,480,430. 189 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,480,431. 73 pages.
*PerfectVision Manufacturing, Inc.* v. *PPC Broadband, Inc., d/b/a PPC*, USDC Eastern District of Arkansas Western Division, Case No. 4-12-CV-623-JLH, Plaintiff's Invalidity Contentions—U.S. Pat. No. 8,485,845. 73 pages.
LIT8_Appendix_ABC; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendices A, B and C, Dated Nov. 19, 2012. 55 pages.
LIT8_Appendix_D; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix D, Dated Nov. 19, 2012. 108 pages.
LIT8_Appendix_E1; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 1-90 pages.
LIT8_Appendix_E2; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 91-182 pages.
LIT8_Appendix_E3; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 183-273 pages.
LIT8_Appendix_E4; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 274-364 pages.
LIT8_Appendix_E5; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 365-450 pages.
LIT8_Appendix_E6; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 451-483 pages.
LIT8_Appendix_E7; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendix E, Dated Nov. 19, 2012. 33 pages.
LIT8_CG_Infringement; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions with Appendices, Dated Nov. 19, 2012. 20 pages.
LIT8_Ex1-23; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions, Exhibits 1-23, Dated Nov. 19, 2012. 229 pages.
LIT8_Ex24-45; *John Mezzalingua Associates, Inc., d/b/a PPC*, v. *Corning Gilbert, Inc.*, USDC, Northern District of New York, Case No. 5:12-cv-00911-GLS-DEP, Defendant Corning Gilbert Inc.'s Disclosure of Non-Infringement, Invalidity, and Unenforceability Contentions, Exhibits 24-45, Dated Nov. 19, 2012. 200 pages.

* cited by examiner 58
56
22
16
14
54
P
60
18
48
46
C
J
B
32
12
52
50
44
36
38
10

15
70

70
56
22
15
5
70

70
56
72
5
72
15

56
80
82

52
22
56

52
80
15
9

80
56
82
9

COAXIAL CABLE CONNECTOR WITH CONDUCTIVE SEAL

PRIORITY CLAIM

This application claims the benefit of U.S. Provisional Application No. 61/490,373, filed May 26, 2011, which is incorporated herein by reference in its entirety.

BACKGROUND

The present disclosure relates to cable termination assemblies; and more particularly, to a novel and improved termination assembly for connecting a coaxial cable to a selected device, such as, the terminal on a home entertainment system, television set, or other device.

SUMMARY

One embodiment relates to a coaxial cable connector for connection to a terminal comprising inner and outer spaced concentric sleeves configured to cooperate in retaining an end of a coaxial cable, at least one of the inner and outer sleeves having a flange at its forward end; a coupling member configured to draw the flange toward an end of the terminal, wherein the coupling member and the flange having confronting surface portions therebetween; and an annular electrically conductive member disposed between the confronting surface portions for establishing conductivity between the coupling member and the flange when the coupling member and the flange are drawn into proximity with one another.

Another embodiment relates to a coaxial cable connector for connection to a terminal comprising inner and outer spaced concentric sleeves configured to cooperate in retaining an end of a coaxial cable, the inner concentric sleeve provided with a radially outwardly directed flange at its forward end; a coupling member for drawing a first annular end of the outwardly directed flange toward a second annular end of the terminal, the coupling member including a radially inwardly directed flange between a forward end of the outer concentric sleeve and the outwardly directed flange of the inner sleeve, the inwardly and outwardly directed flanges having confronting surface portions defining an annular recess therebetween; and an annular electrically conductive member disposed in the recess and being compressible between the confronting surface portions when the inwardly and outwardly directed flanges are drawn into flush engagement with one another.

Another embodiment relates to a coaxial cable connector for connection to a terminal comprising inner and outer spaced sleeves configured to cooperate in retaining an end of a coaxial cable, the inner sleeve provided with a radially outwardly directed first flange, the outer sleeve provided with a radially outwardly directed second flange; a coupling member comprising an inwardly directed flange disposed at least partially between the first and second flanges; an annular electrically conductive sealing member disposed between the first flange and the inwardly directed flange of the coupling member and configured to maintain electrical conductivity between the inner sleeve and the coupling member; and a resilient conductive member disposed between the second flange and the inwardly directed flange of the coupling member and configured to maintain electrical conductivity between the outer sleeve and the coupling member.

BRIEF DESCRIPTION OF THE DRAWINGS

The present disclosure will become more readily appreciated and understood from a consideration of the following detailed description of various embodiments of the present invention when taken together with the accompanying drawings, in which.

DETAILED DESCRIPTION

Various embodiments disclosed herein provide for a novel and improved compression connector for cables, and specifically, for coaxial cables. For example, in F-connectors designed specifically for connection to a port or terminal of an entertainment or security system, an electrically conductive, watertight seal is disclosed herein for use in combination with an annular coupling member to maintain optimum electrical conductivity between the coaxial cable and port. In one embodiment, an electrically conductive seal is in the form of a rubber or resilient O-ring containing electrically conductive particles and is mounted so as to be compressible between a port and the end of the cable connector. In another embodiment, a conductive spring is utilized in combination with an elastomeric seal and a spring mounted between confronting surface portions of an outer connector sleeve and a coupling member. In still another embodiment, a conductive spring in the form of an arcuate band is mounted between confronting surface portions of the connector sleeve and coupling member, but spaced or removed away from the seal member.

Coaxial cables often include inner and outer concentric conductors separated by a dielectric insulator and encased or covered by an outer jacket of a rubber-like material. Numerous end connectors have been devised to effect a secure mechanical and electrical connection between a termination assembly (e.g., a coaxial cable connector) and the end of the coaxial cable, typically by having the inner conductor and dielectric insulator extend through an inner sleeve of the termination assembly while the outer conductor and jacket are inserted into an annular space between the inner sleeve and an outer sleeve. The outer sleeve is then crimped in a radially inward direction or otherwise compressed, etc. to securely clamp the end of the cable within the connector, and a fastener such as a nut on the opposite end of the connector is then connected to a port or terminal.

U.S. Pat. No. 5,975,949 illustrates a coaxial cable connector of the type described and with a somewhat modified form of watertight seal which is interposed between confronting surface portions of a flange at the end of the inner sleeve and the end of a coupling member which extends from the post or terminal. Nevertheless, in certain applications, there is a continuing need for a compression-type coaxial cable and connector which can achieve improved mechanical and electrical connection between the coaxial cable connector and the port or terminal including a novel and improved watertight but electrically conductive seal which will maintain the necessary conductivity and which is mounted in such a way as to resist accidental loosening of the coupling member between the connector and port or terminal.

Figures 1, 2, 3:
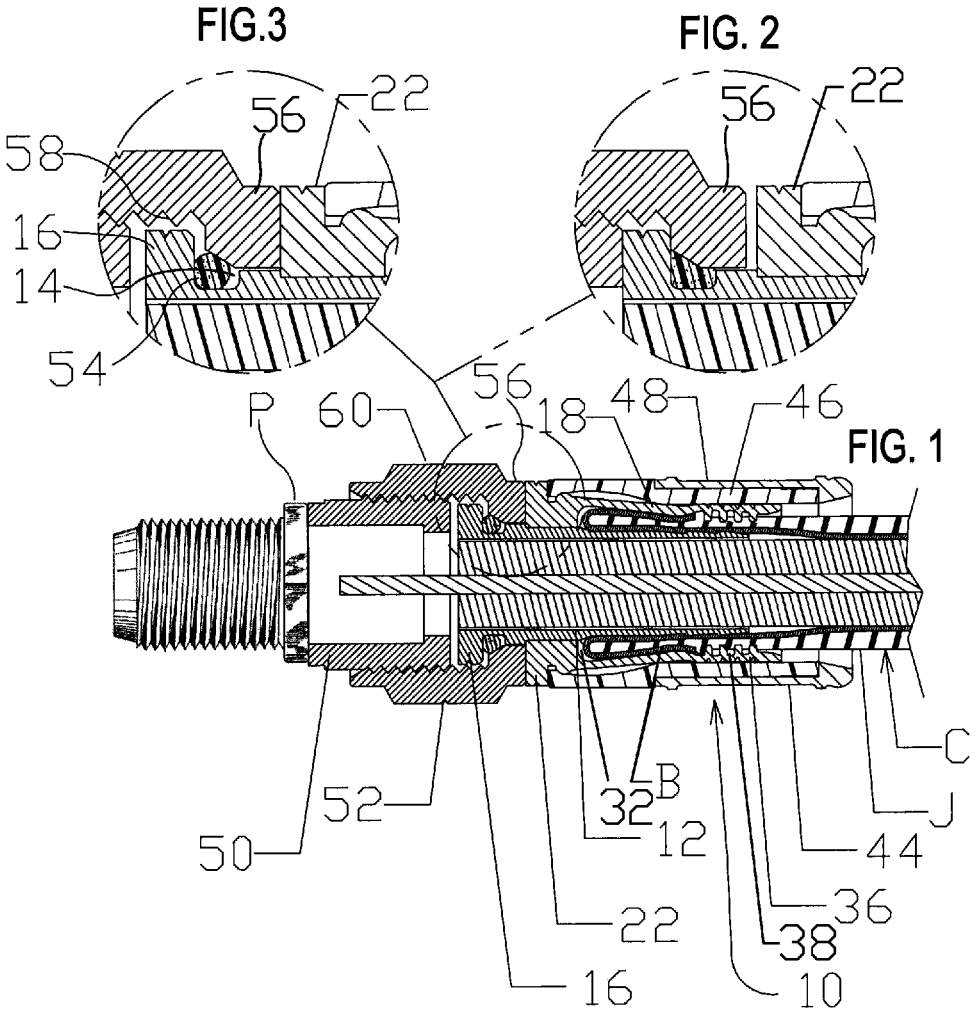
FIG. 1 is a longitudinal section view of one embodiment with a cable and seal in a loosely assembled position.
FIG. 2 is an enlarged view in section of the conductive seal of FIG. 1 in a loosely assembled position prior to installation according to an exemplary embodiment.
FIG. 3 is another enlarged sectional view in detail of the conductive seal of FIG. 1 in a fully tightened position according to an exemplary embodiment.

Referring in more detail to the drawings, one embodiment is illustrated in FIGS. 1 to 3 wherein the assembly is made up of an end connector 10 for connecting a first electrically conductive member, such as, a standard coaxial cable C to a second electrically conductive member, such as, a port or terminal P on different components of a home entertainment system, etc. According to an exemplary embodiment, connector 10 includes an elongated thin-walled inner sleeve 12 or post at an entrance end. In some embodiments, sleeve 12 increases in thickness along a midportion into an external groove 14 and terminates in an external shoulder 16. Connector 10 further includes an outer thin-walled sleeve 18 extending from a point slightly beyond the sleeve 12 at the entrance end, and in some embodiments being of uniform thickness along its greater length. Sleeve 18 may be provided with an external groove which is flanked at one end by external shoulder 22.

In one embodiment, inner and outer sleeves 12 and 18 extend rearwardly from the entrance end in spaced concentric relation to one another so as to form an annular space 32 therebetween for insertion of a standard cable C in a manner to be described Inner sleeve 12 may be of substantially uniform wall thickness for its greater length and have a plurality of axially spaced, annular serrations along its outer wall surface and toward the entrance end. Outer sleeve 18 may be thin-walled along its greater length, but gradually increases in thickness to define an external convex surface portion 36 and which has a plurality of axially spaced sealing rings or grooves 38 in accordance with U.S. Pat. No. 5,501,616.

According to an exemplary embodiment, a crimping ring 44 (compression member, etc.) of generally cylindrical configuration may be configured to extend over at least a portion of outer sleeve 18, and may have a length generally corresponding to the length of the thin-walled sections of outer sleeve 18. In some embodiments, member 44 includes an inner liner 46 that may be of uniform thickness and diameter throughout which terminates in opposed beveled ends, and an outside band 48 that may be of generally uniform thickness and diameter throughout at least a portion of its length and may be coextensive with inner liner 46. In some embodiments, inner liner 46 is composed of a material having a slight amount of give or resilience; and outer band 48 is composed of a material having little or no give or compressibility, such as, a brass material Inner liner 46 and band 48 may in some embodiments be of substantially corresponding thickness, and inner liner 46 may be mounted in a press-fit or other fashion inside of band 48, with its inner wall surface being of a diameter corresponding to or slightly greater than the outer diameter of outer sleeve 18 at its entrance end Inner liner 46 may in some embodiments have an inner diameter less than the convex surface portion 36 on outer sleeve 18 so that when ring 44 is axially advanced, ring 44 will impart inward radial deformation to the convex surface portion of outer sleeve 18 causing it to be contracted, as illustrated in FIG. 1, into engagement with the cable C.

The cable C is connected to the connector 10 in the usual manner by first preparing the leading end of the cable to fold the braided layer B over the end of the jacket J, as illustrated in FIG. 1. Compression ring 44 is aligned, as illustrated in FIG. 1, with the end of connector 10, following which the leading end of cable C is advanced through compression ring 44 and into annular space 32 formed between inner sleeve 12 and outer sleeve 18. A standard compression tool may be used to impart sufficient axial force to advance compression ring 44 over convex surface portion 36 to radially deform or contract that portion of sleeve 18 inwardly, and portion 36 will be bowed or deformed, etc. in a radially inward direction, as shown in FIG. 1, and cause jacket J, as well as at least a portion of braided layer B, to be compressed slightly between inner and outer sleeves 12 and 18. Once the installation is completed, a starter guide, if used, may be removed from the end of the pin conductor and discarded. A compression tool (not shown) is shown and described in detail in U.S. Pat. No. 6,708,396 which is incorporated by reference herein. While the Figures herein generally show a compression member moving axially over a compressible outer sleeve to secure a coaxial cable relative to the coaxial connector, other forms of securing the cable may be used, such as a deformable locking sleeve being axially compressed within a connector body to similarly secure the coaxial cable in position. All such alternative embodiments are to be understood to be within the scope of the present disclosure.

Port or terminal P may have a hollow externally threaded extension 50 to receive the inner conductor pin of the cable C and is coupled to the end of the connector 10 by a coupling member, such as, a nut 52 which is internally threaded with threads 58 to mate with the external threading on extension 50 whereby to draw extension 50 toward and/or into engagement with flange 16 on the end of inner sleeve or post 12 of connector 10. In order to provide for improved conductivity between connector 10 and port P, and in particular to maintain the necessary conductivity notwithstanding a poor connection or loosening of the coupling members between the conductor pin and port P, an electrically conductive, watertight annular seal 54 (e.g., a conductive o-ring, resilient member, elastomeric member, etc.) may mounted in a groove 14 adjacent to flange 16 and coupling member 52. Coupling member 52 may extend forwardly from an end wall 56 over and beyond flange 16, and may be internally threaded to facilitate connection to extension 50 of the port P. Exterior surface 60 of coupling member 52 may be provided with suitable flats (e.g., a generally hexagonal configuration, etc.) for engagement by a wrench or other suitable tool to rotate coupling member 52 independently from the remainder of connector 10.

According to an exemplary embodiment, seal 54 may take the form of an o-ring, and may be composed of an elastomeric material having electrically conductive particles uniformly or non-uniformly distributed within seal 54, one example of such particles being carbon fibers. In the loosely assembled position shown in FIGS. 1 and 3, seal 54 is in a relaxed state and not necessarily in direct contact with the adjacent or confronting surfaces of the flange 16 and end wall 56 of the coupling member 52. However, when the coupling member 52 is rotated to draw the port into contacting relation to the forward end of flange 16 opposite to seal 54, end wall 56 will be drawn toward the opposite surface of flange 16 to compress the seal 54 between the end wall 56 and flange 16, as shown in detail in FIGS. 2 and 3. As a result, a conductive path is established between inner sleeve 12 and end wall 56 of coupling member 52. It will be appreciated that seal 54 will maintain the necessary contacting relationship between the confronting surfaces notwithstanding a slight loosening between the parts, such as, as a result of temperature changes or wear. An important advantage of utilizing a watertight, conductive seal as one member or unit is that it serves a dual function of providing a watertight seal which is also electrically conductive; and at the same time the seal diameter may be varied to compensate for differences in connector size and the gap between the confronting surfaces of flange 16 and end wall 56, as well as variations in type of connector.

Figures 4, 5, 6, 7:
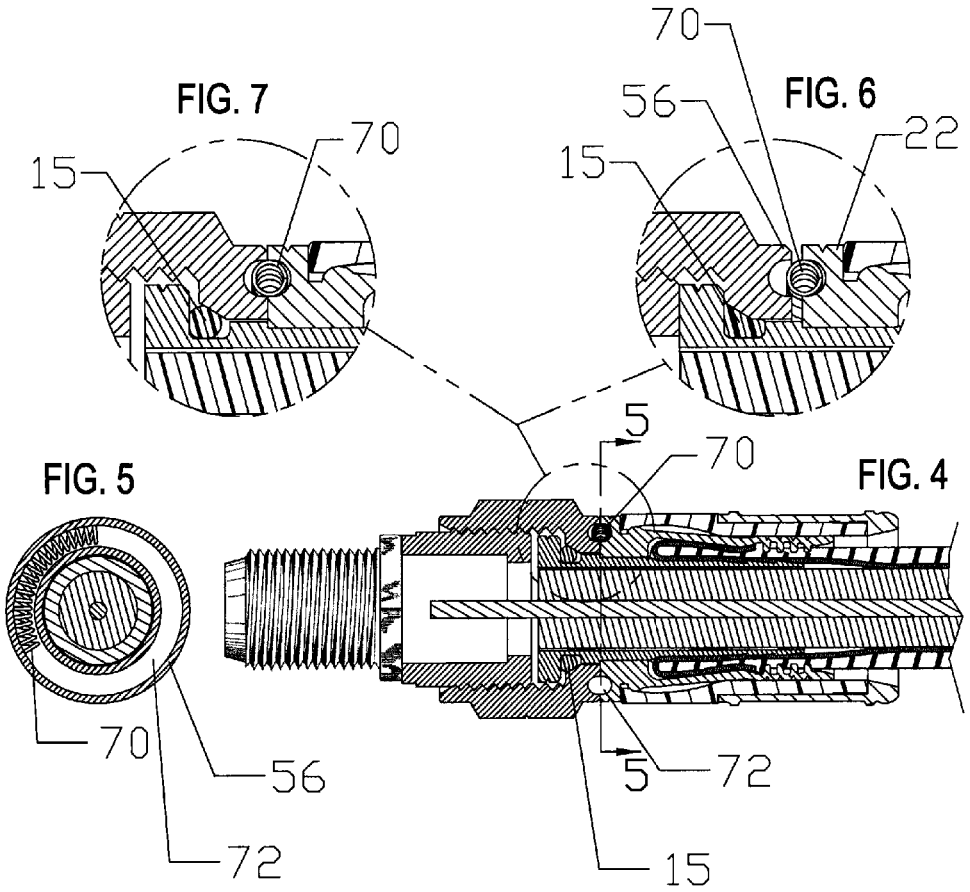
FIG. 4 is a longitudinal sectional view of another embodiment utilizing a conductive spring member and illustrating the cable in an assembled position.
FIG. 5 is a cross-sectional view taken about lines 5-5 of FIG. 4 according to an exemplary embodiment.
FIG. 6 is an enlarged view in detail of the spring member of FIG. 4 shown in a tightly assembled position according to an exemplary embodiment.
FIG. 7 is another sectional view in detail of the spring member of FIG. 4 in a loosely assembled position according to an exemplary embodiment.

FIGS. 4-7 illustrate another embodiment of an electrically conductive compressible member in the form of a coil spring 70, which may be mounted under compression in a recessed area or gap 72 between end wall 56 and external shoulder 22 at an end of outer sleeve 18 of connector 10, as illustrated in FIGS. 4-7. According to an exemplary embodiment, shoulder 22 has a squared end surface in normally abutting relation to a squared end surface on end wall 56 of coupling member 52. In some embodiments, rather than to replace a standard 0-ring seal 15, spring coil 70 may be mounted under compression within the complementary recessed portions that define gap 72 between the respective confronting surface portions of end wall 56 of coupling member 52 and shoulder 22 of outer sleeve 18. As best seen from the end view of FIG. 5, it is not necessary for the spring 70 to extend around the entire circumference of the connector body to maintain electrical conductivity between outer sleeve 18 and coupling member 52. However, spring 70 may be of a diameter and under sufficient compression to expand and to maintain electrical contact between sleeve 18 and coupling member 52 (e.g., between the confronting surfaces of sleeve 18 and coupling member 52) notwithstanding slight separation between them, for example, as shown in FIG. 6.

Figures 8, 9, 10, 11:
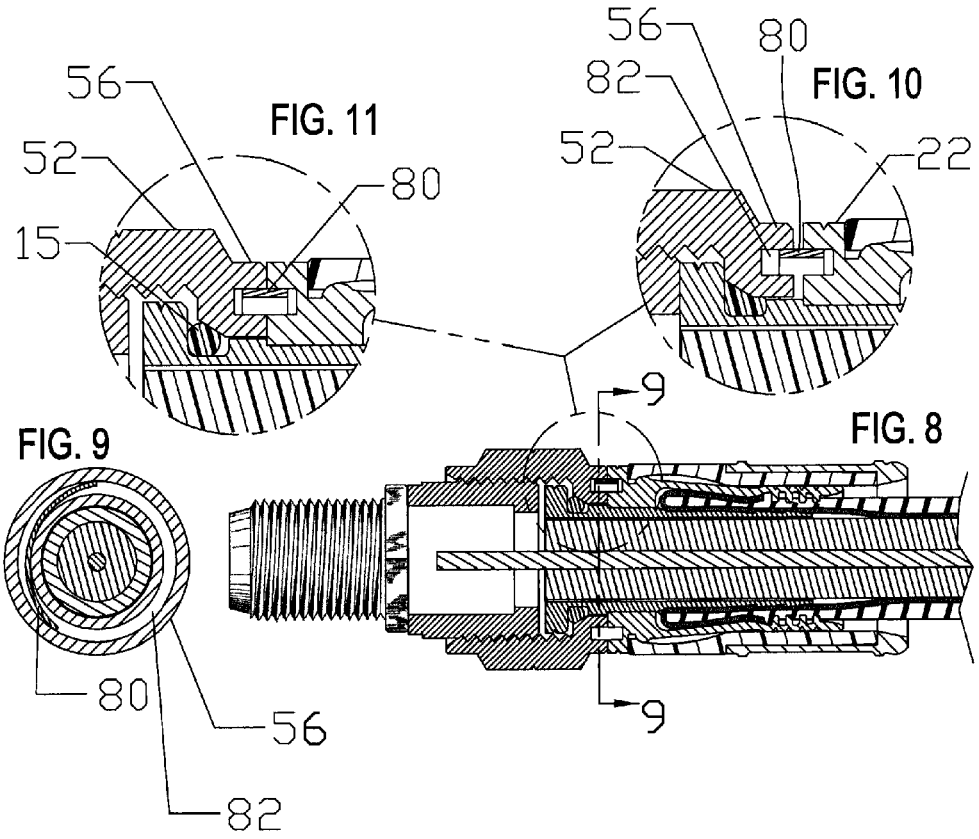
FIG. 8 is a longitudinal section view of still another embodiment utilizing a flat spring as a conductive member and being shown in a fully assembled position.
FIG. 9 is a cross-sectional view taken about lines 9-9 of FIG. 8 according to an exemplary embodiment.
FIG. 10 is an enlarged sectional view in detail of the seal and spring in a tightly assembled position according to an exemplary embodiment.
FIG. 11 is another enlarged sectional view in detail of the seal and spring of FIG. 8 in a loosely assembled position according to an exemplary embodiment.

Another embodiment of a conductive ring is illustrated in FIGS. 8-10, wherein like parts to those of FIGS. 1-7 are correspondingly enumerated, and, in a manner similar to that described in connection with the embodiment of FIGS. 4-7, a spring-like, generally circular band 80 may be mounted in a gap 82 defined by annular recessed portions in facing relation to one another in external shoulder 22 of outer sleeve 18 and end wall 56 of coupling member 52. According to an exemplary embodiment, band 80 may be composed of a resilient electrically conductive material such as a metal which is normally flat, but when inserted into gap 82 may be bent, as illustrated in FIG. 9, so that opposite ends of band 80 yieldingly engage circumferentially spaced surface portions of the outer wall of gap 82, and an intermediate portion of band 80 is in contact with the inner wall of gap 82. Also, band 80 may be of a width sufficient to extend along a substantial portion of the width of gap 82. As illustrated in FIG. 10, in some embodiments, band 80 will maintain electrical conductivity between outer sleeve 18 and coupling member 52 notwithstanding separation between the components; and when member 52 is adjacent the end of the sleeve 18, as shown in FIG. 11, band 80 will traverse a substantial width of gap 82.

According to alternative embodiments, the conductive ring members 70 and 80 could be composed of various materials or composite materials which would offer the same characteristics of resiliency and conductivity. For example, one or both of members 70 and 80 could be composed of an inner matrix of plastic with an outer coating of a conductive material, such as, the carbon fibers referred to in connection with FIGS. 1-3. As in the case of helical spring member 70, band 80 does not have to extend throughout the entire annular gap, for example, as illustrated in FIG. 9. In this respect, band 80 would assume a somewhat arcuate configuration when inserted into the gap between the confronting surface portions of the shoulder 22 and end wall 56.

Although the different forms of connector sleeves are illustrated for use in F-connectors as in FIGS. 1 to 11, it will be apparent that they are readily conformable for use with other types of connectors, such as, but not limited to BNC and RCA connectors. It is therefore to be understood that while selected forms of invention are herein set forth and described, the above and other modifications may be made therein without departing from the spirit and scope of the invention as defined by the appended claims and reasonable equivalents thereof

What is claimed is:

1. A coaxial cable connector for connection to a terminal comprising:

inner and outer spaced sleeves configured to cooperate in retaining an end of a coaxial cable, the inner sleeve comprising a radially outwardly directed first flange, the outer sleeve having a radially outwardly directed second flange;

a coupling member having an inwardly directed flange configured to be disposed at least partially between the first and second flanges, the flanges of the outer sleeve and coupling member each forming a recess therein, the recesses comprising inner and outer walls defining a radial gap;

an annular sealing member disposed between the first flange and the inwardly directed flange of the coupling member; and a resilient conductive member configured to be disposed within the recesses and contacting the inner and outer walls so as to maintain electrical conductivity across the radial gap between the outer sleeve and the coupling member, the resilient conductive member being positioned between the recesses to maintain the electrical conductivity between the outer sleeve and the coupling member even when a gap is formed between the outer sleeve and the coupling member.

2. The connector of claim 1 wherein the annular sealing member comprises an elastomeric material containing electrically conductive particles.

3. The connector of claim 2 wherein the electrically conductive particles are composed at least in part of carbon fibers.

4. The connector of claim 1 wherein the resilient conductive member comprises a spring.

5. The connector of claim 4 wherein the spring is a flat spring extending at least partially about the recess.

6. The connector of claim 4 wherein the spring is a coil spring extending circumferentially within the recess.

7. The connector of claim 1 wherein the annular sealing member comprises an electrically conductive o-ring, and wherein the resilient conductive member comprises a spring extending only partially about an annular recess defined by the second flange and the inwardly directed flange of the coupling member.

8. The connector of claim 1, wherein the outer sleeve is a deformable sleeve.

9. The connector of claim 1, the resilient conductive member comprising an inner matrix of plastic with an outer coating of a conductive material.

10. A coaxial cable connector comprising:

a post comprising a radially outwardly directed first flange;

an outer sleeve comprising a radially outwardly directed second flange, the post and the outer sleeve configured to cooperate in retaining an end of a coaxial cable;

a coupling member comprising an inwardly directed flange configured to be disposed at least partially between the first and second flanges, the flanges of the outer sleeve and coupling member each forming a recess therein, the recesses comprising inner and outer walls defining a radial gap; and a coil spring configured to be disposed within the recesses and contacting the inner and outer walls so as to maintain electrical conductivity across the radial gap between the outer sleeve and the coupling member, the coil spring being positioned between the recesses to maintain the electrical conductivity between the outer sleeve and the coupling member even when the outer sleeve and the coupling member do not contact one another.

11. The coaxial cable connector of claim 10, the inwardly directed flange comprising an end wall configured to abut the second flange.

12. The coaxial cable connector of claim 10, the recess is defined by a first complementary recessed portion of the second flange and by a second complementary recessed portion of the inwardly directed flange.

13. The coaxial cable connector of claim 12, the recess extending around a circumference of the coaxial cable connector.

14. The coaxial cable connector of claim 13, the coil spring extending partially around the circumference.

15. A coaxial cable connector comprising:

a post comprising a first flange;

a sleeve comprising a second flange, the post and the sleeve configured to retain an end of a coaxial cable;

a coupling member comprising a third flange configured to be disposed at least partially between the first flange and the second flange, the flanges of the sleeve and coupling member each forming a recess therein, the recess comprising inner and outer walls defining a radial gap; and a band configured to be disposed within the recess and contacting the inner and outer walls so as to maintain electrical conductivity across the radial gap between the outer sleeve and the coupling member, the band being positioned in between the recesses to maintain the electrical conductivity between the sleeve and the coupling member even when the sleeve does not electrically contact the coupling member.

16. The coaxial cable connector of claim 15, the band comprising an arcuate band.

17. The coaxial cable connector of claim 15, the band comprising two ends and an intermediate portion, the two ends yieldingly engaging circumferentially spaced surface portions of the sleeve, and the intermediate portion being in contact with the post.

18. The coaxial cable connector of claim 17, the recess extending around a circumference of the coaxial cable connector.

19. The coaxial cable connector of claim 18, the band extending partially around the circumference.

20. The coaxial cable connector of claim 15, the recess is defined by a first complementary recessed portion of the second flange and by a second complementary recessed portion of the third flange.

* * * * *